United States Patent [19]

Bammert et al.

[11] 4,116,584

[45] Sep. 26, 1978

[54] DEVICE FOR EXTENDING THE WORKING RANGE OF AXIAL FLOW COMPRESSORS

[75] Inventors: Karl Bammert, Hanover; Rudolf Staude, Bottrop, both of Germany

[73] Assignee: Gutehoffnungshütte Sterkrade AG, Oberhausen, Germany

[21] Appl. No.: 765,758

[22] Filed: Feb. 4, 1977

Related U.S. Application Data

[63] Continuation-in-part of Ser. No. 668,834, Mar. 22, 1976, abandoned, which is a continuation of Ser. No. 513,406, Oct. 9, 1974, abandoned.

[30] Foreign Application Priority Data

Oct. 12, 1975 [DE] Fed. Rep. of Germany ..... 2351308

[51] Int. Cl.[2] ..... F01D 1/02; F01D 9/04; F04D 29/54

[52] U.S. Cl. ..... 415/199.5; 415/208; 415/217; 415/DIG. 1; 416/193 R

[58] Field of Search ..... 415/208, 209, 210, DIG. 1, 415/216, 217, 218, 183, 199.4, 199.5; 416/193 R

[56] References Cited

U.S. PATENT DOCUMENTS

| | | | |
|---|---|---|---|
| 2,169,232 | 8/1939 | Flanders | 415/208 X |
| 2,219,937 | 10/1940 | Ponomareff | 415/199.4 X |
| 2,407,807 | 9/1946 | Bentley | 415/DIG. 1 UX |
| 3,193,185 | 7/1965 | Erwin et al. | 415/199.5 X |
| 3,652,184 | 3/1972 | Conrad | 415/209 X |

FOREIGN PATENT DOCUMENTS

| | | | |
|---|---|---|---|
| 1,064,191 | 8/1959 | Fed. Rep. of Germany | 415/209 |
| 716,236 | 12/1954 | United Kingdom | 415/199.5 |
| 985,776 | 3/1965 | United Kingdom | 415/DIG. 1 |

*Primary Examiner*—Carlton R. Croyle
*Assistant Examiner*—Donald S. Holland
*Attorney, Agent, or Firm*—Toren, McGeady and Stanger

[57] ABSTRACT

In an axial flow compressor including a rotor wheel having a plurality of rotating blades mounted thereon, said rotor being arranged to rotate about a central axis of the compressor, there is provided an aerodynamically profiled ring arranged concentrically to the compressor axis in front or upstream of the plurality of rotating blades in order to define between an outer surface of the profiled ring and an inner wall of the compressor casing an annular flow channel which converges in the direction of flow through the compressor. A plurality of stationary blades are located upstream of the profiled ring.

6 Claims, 5 Drawing Figures

DEVICE FOR EXTENDING THE WORKING RANGE OF AXIAL FLOW COMPRESSORS

This application is a continuation-in-part application of application Ser. No. 668,834 filed Mar. 22, 1976 which is a continuation of application Ser. No. 513,406 filed Oct. 9, 1974. Both of these earlier applications are now abandoned.

BACKGROUND OF THE INVENTION

The present invention relates generally to single or multistage axial flow compressors and more particularly to a device for extending the working range thereof.

Generally, the working range of single or multistage axial flow compressors during throttling with decreasing mass throughput is limited due to the so-called pumping phenomenon which occurs. In an axial flow compressor, the flow will tend to become turbulent and completely break away. Furthermore, it is known that axial flow compressors, prior to reaching the pumping limit, operate in a range in which flow breaks away partly on the blades. Also, so-called rotating stalls are then formed. Due to the occurrence of the rotating stalls, corresponding axial compressor blades experience vibrations which under certain circumstances can lead to failure of the blades. Depending upon the throttling stage and the speed ratio, there may occur up to eight rotating stalls which under certain circumstances could be capable of causing blade ruptures. Examinations of blade vibrations caused by rotating stall have also shown that alternating bending stresses are developed which amount to between about 2.5–3 times the bending caused by gas forces under static conditions. The blade materials must thus meet much higher requirements when rotating stall is present.

In order to avoid such effects of rotating stall, it has been suggested to provide binding or damping wires in the jeopardized rings of the blade. Such wires are arranged to connect with each other the individual blades of a blade ring in the circumferential direction. Their function is to damp as far as possible blade vibrations caused by rotating stall, or to eliminate such vibration completely in order to avoid vibration failure of the blades.

A disadvantage of utilizing such damping wires arises as a result of the fact that the wires introduce additional flow resistances into the compressor. For example, for a multistage flow compressor, the efficiency may be reduced by as much as 5% for a damping wire.

Another approach which has been known for some time involves the use of suitable blow-off or reblowing controls. It has been known that the additional stresses on the blades of axial flow compressors, as they appear in pumping and in rotating stall, can be avoided by adapting the working range of the axial flow compressor by means of such blow-off or reblowing controls to the changing reduction. However, utilization of these methods has been found to be relatively uneconomical since only a part of the throughput is delivered to the load while a a remaining part is reblown or blown off.

In addition to fixed blow-off or reblowing controls, which constantly limit the characteristic fluid, there is known a safety control device which acts only when rotating stall appears. This device first determines the appearance of rotating stall by means of a Pitot tube arranged behind a runner in the circumferential direction. When rotating stall appears, a blow-off valve arranged in the pressure line is opened over a control device. The valve closes again after the compressor has entered the stable working range. This safety device differs from presently known pumping prevention devices in that the blow-off valve opens automatically in the case of rotating stall.

However, devices of this type exert no influence on the causes of rotating stall. Furthermore, other disadvantages arise due to the fact that the device is relatively elaborate.

In addition to the foregoing, it has also been suggested that shroud bands be utilized in order to avoid blade vibrations in axial flow compressors. Although the use of shroud bands or guide wheels is known, shroud bands cannot be used for the blade wheels of axial flow compressors operating at contemporary circumferential speeds because of the appearance of high centrifugal forces. With binding or damping wires, or with shroud bands, it is possible to avoid blade vibrations caused by rotating stall without influencing the formation of the rotating stall. It has also been suggested to shield, at a relatively early stage, the outer return flow region which appears during pumping by arranging a concentric non-airfoil ring (i.e., a ring not having an airfoil cross section relatively close to the compressor casing wall in front of a blade wheel in order to influence the location of the pumping limit. A disadvantage of this approach involves the fact that the approaching flow direction to the following blade wheel is not changed so that the appearance of rotating stall cannot be avoided. Initially, it must be taken into consideration that flow breaks away at the non-airfoil ring and thus rather enhances the formation of rotating stalls. Indeed, it is likely that flow will stall on the non-airfoil ring and there will rather be an increase in the formation of rotating stall. Furthermore, the flow stalled on the non-airfoil ring causes considerable losses so that machine efficiency is substantially reduced for the axial flow compressor.

On the other hand, added loading upon the blading of axial flow compressors, as might occur in pumping and in rotating stall, is avoided since the working range of the compressor is limited by means of a suitable blow-off or by deflection regulators. However, it becomes apparent that both methods are relatively uneconomical, since only a part of the delivered throughput is applied to the load while the remaining portion is deflected or blown off.

There are also known proposals to arrange so-called profiled hub rings in the vicinity of the hub to avoid hub detachment in axial flow machines. However, since these rings only influence the formation of hub detachments, they cannot avoid the formation of rotating stall. Also, the hub ring cannot achieve change in the overflow direction of the succeeding wheel, inasmuch as the ring surfaces are the same on the inlet and outlet side of the hub ring. Thus, a converging annular wind tunnel is not formed in the range of the casing wall.

With the aforementioned considerations, it is only possible to maintain the effects of rotating stall within certain limits. The causes of rotating stall, which arise from the fact that the aerodynamic load capacity of the cascades is partially exceeded, cannot be influenced.

The present invention is essentially directed toward avoiding the aforementioned disadvantages and toward extending the working range of axial flow compressors toward lower output volumes with minimum additional flow losses. This is accomplished in the present invention by utilization of a suitable device whereby the occurrence of rotating stall is, as far as possible, prevented.

SUMMARY OF THE INVENTION

Briefly, the present invention may be described as a device for extending the working range of an axial flow compressor which includes a rotor wheel having a plurality of rotating blades with the compressor having a central axis about which the rotor rotates. The invention is specifically directed toward the inclusion in the compressor of a ring of airfoil cross section which is arranged concentrically to the compressor axis in front or upstream of the plurality of rotating blades and which, together with the inner wall of the compressor casing, defines an annular flow channel which converges in the direction of flow through the compressor with a plurality of stationary blades being located upstream of the profiled ring.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
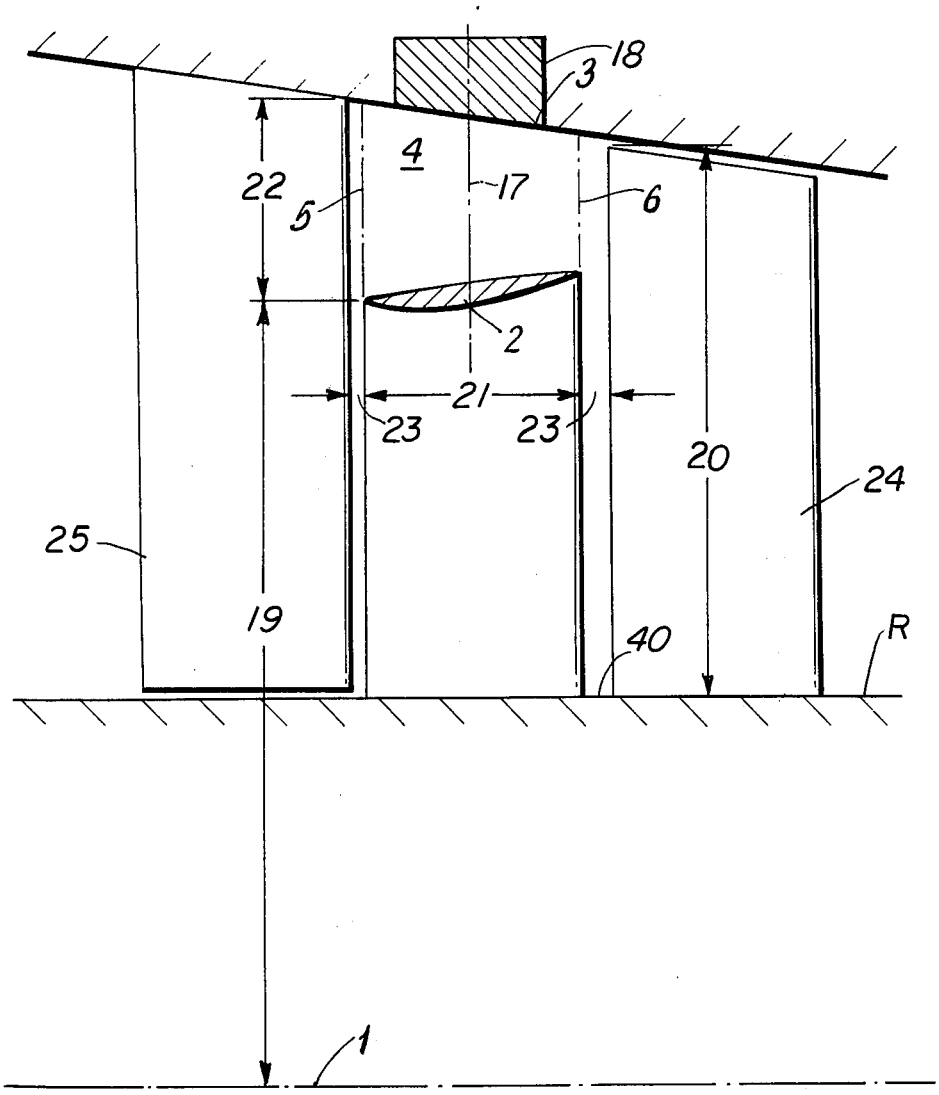
FIG. 1 is a sectional view of a part of an axial flow compressor utilizing the present invention.

Referring now to FIG. 1, there is shown the specific structure whereby problems previously discussed may be avoided in a compressor having a central machine axis 1 and a rotor R having mounted thereon a plurality of rotating blades 24. The compressor includes a casing having an inner casing wall 3. A ring 2 having an airfoil cross section is arranged concentrically to the machine axis 1 in front or upstream of one or several blade rows with the ring being so designed that an annular shaped flow channel 4 converging in the direction of flow through the compressor is formed between the casing wall 3 and the outer surface of the concentric airfoil ring 2.

The casing wall 3 is configured relative to the peripheral surface 40 of the rotor R in a manner forming the overall compressor flow conduit defined therebetween with a converging configuration taken in a direction downstream of the flow therethrough. Furthermore, as clearly shown in the drawings, a plurality of stationary blades 25, which may be mounted to extend from the casing wall 3 are arranged upstream of the ring 2. Thus, the ring, as shown in FIG. 1, is located between the stationary blades 25 and the rotating blades 24 and upstream of the rotating blades 24 within the compressor flow conduit defined between the wall 3 and the periphery of the rotor R.

The ring 2 is mounted and supported within the converging flow channel 4 by a plurality of radial support elements or bolts 17. The bolts 17 extend from a retaining ring 18 which is secured directly on the casing wall 3. The mounting arrangement of the ring 2 by the bolts 17 and the retaining ring 18 is shown in greater detail in FIGS. 4 and 5. As seen therein, the ring 2 is divided along a horizontal plane with the two halves of the ring being connected together at joints 30. The bolts 17 may be internally threaded and attached to the ring 2 by set screws 32.

Figure 4:
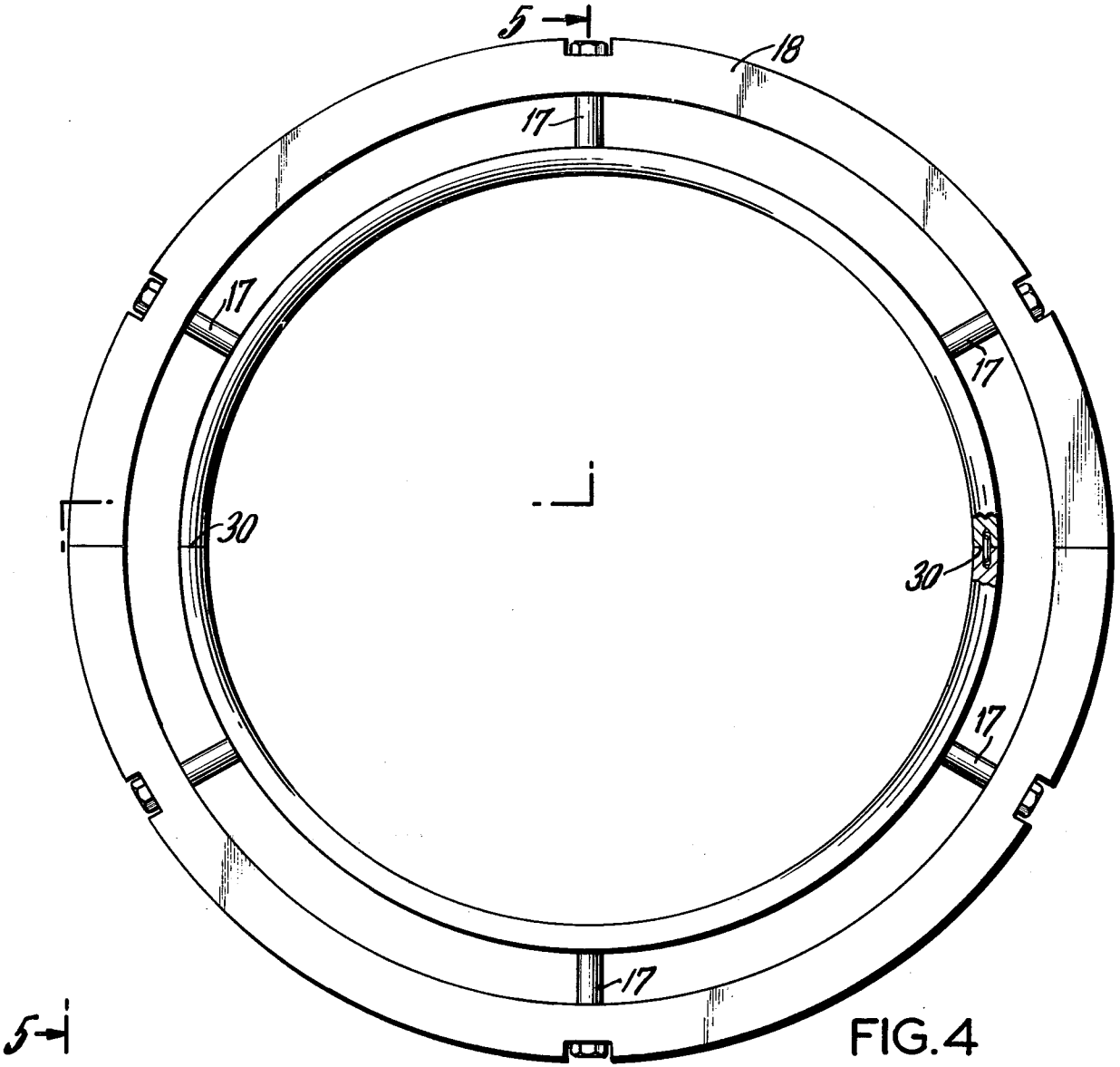
FIG. 4 is an end view looking axially of the compressor showing an aerodynamic ring in accordance with the invention and a retaining ring therefor.

As will be seen from FIG. 4, each half of the ring 2 is supported by three bolts 17. Since the bolts 17 are located in the range of an accelerated flow, no adverse effect on the flow need be expected from the bolts. An advantage derived from the ring mounting arrangement of the invention is that since the forces which must be absorbed by the bolts are relatively weak, bolts of relatively small diameters may be utilized thereby further reducing the effects on the flow.

Figure 5:
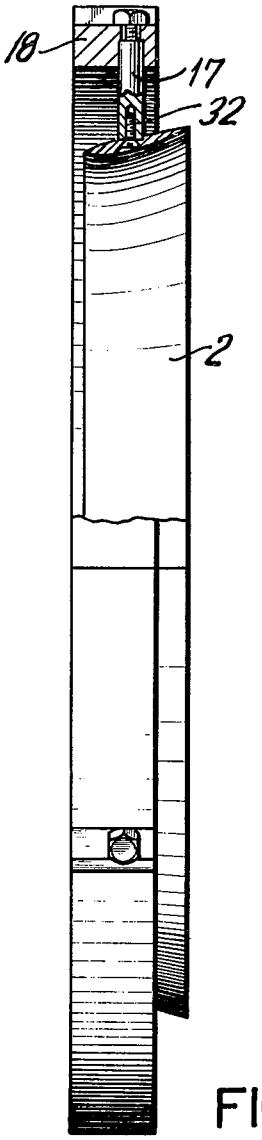
FIG. 5 is a side view partially in section of the assembly of FIG. 4, taken along the line 5—5.

With the arrangement depicted in FIGS. 1, 4 and 5, the ring 2 will have an axial width 21 and gaps 23 will be formed in the axial direction between the stationary blades 25 and the ring 2, and between the rotating blades 24 and the ring 2.

The upstream edge of the ring 2 will be located at a radial distance 19 from the center 1 of the rotor R and the maximum height or radial dimension of the converging flow channel 4 will be the distance 22. The flow channel 4 has an inlet area 5 which is greater than its outlet are 4. The rotating blades 24 have a maximum radial length 20.

In accordance with the present invention, certain parameters are maintained to insure optimum performance characteristics. The radial distance 19 is selected to be between about 65%–70% of the radial blade length 20. The ratio between the inlet area 5 and the outlet area 6 of the flow channel 4 is between about 1.3–2.0. Both of the gaps 23 shown in FIG. 1 are of a distance which is at least 10% of the axial width 21 of ring 2.

Figure 2:
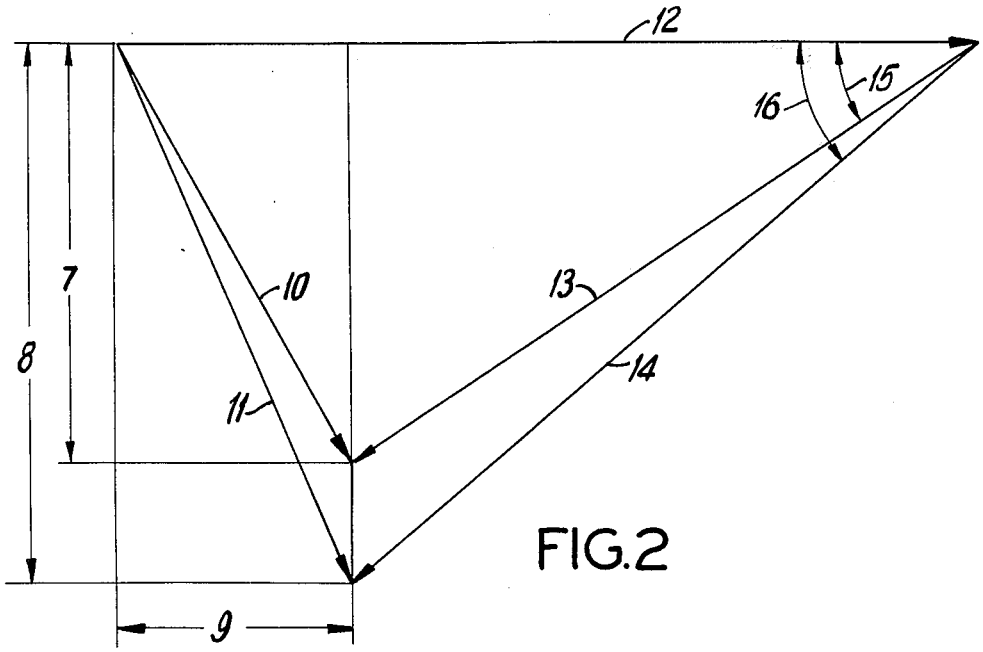
FIG. 2 is a graphical illustration of the operating characteristics of the compressor taken in view of the present invention.

In FIG. 2 there is shown the influence which the concentric airfoil ring 2 will effect upon the flow if it is arranged, for example, in front of the rotor wheel. Since the flow channel 4 comprises an inlet area 5 which is greater than the outlet area 6 thereof, inasmuch as the flow channel converges in the flow direction, flow is accelerated from an axial velocity 7, shown in FIG. 2, to an axial velocity 8. Since the convolution of the flow is not changed by the concentric airfoil ring 2, the centrifugal component 9 of the absolute velocity 10 is maintained, which corresponds to the absolute velocity of flow without the ring 2.

After vectorial addition of the axial velocity 8 and of the circumferential component 9, there may be obtained for the case where a ring 2 is utilized an absolute velocity 11. Having the same circumferential velocity 12, there may then be obtained for the blade profiles of the following blade ring relative approach flow velocities 14 and 13 for cases with and without the ring, respectively.

It will also be seen from FIG. 2 that with such a ring installed, a flow angle 16, which the relative approach flow velocity 14 forms with the circumferential velocity 12, is greater than the flow angle 15 which results without such a ring. Flow angle 16 is measured at the trailing edge of ring 2.

Consequently, the blade profiles are impinged or hit with greater intensity in the range behind the convergent annular flow channel 4 on the suction side, as compared to the prior art. The stress and impact on the blades is thus reduced in the range near the free ends of the rotating blades and the formation of the rotating stall, which begins from the detachment of the flow at the profiles on the suction side, is avoided. If the axial flow compressor is throttled, axial velocity 8 decreases. The blade profiles are approached in the zone behind the converging annular channel 4 with a decreasing flow angle 16 until flow breaks away at the profile and a pumping limit is reached.

By contrast with rings which are known from the state of the art, the concentric ring of the present invention is structured as a ring of airfoil cross section which forms with the casing inner wall a convergent annularly shaped flow channel. While the function of the known ring is to prevent return flow in the region close to the wall at the pumping limit, the approach flow angle is increased in the outer zones with the ring 2 of the present invention in order to avoid a premature breakaway of the flow.

The extension of the working range by means of the ring according to the present invention occurs by virtue of the fact that the aerodynamic load is reduced by the ring in the range near the free ends of the rotating blades so that, when the compressor is throttled, the flow breakaway occurs at the blades at a later time than would otherwise occur without the ring.

Figure 3:
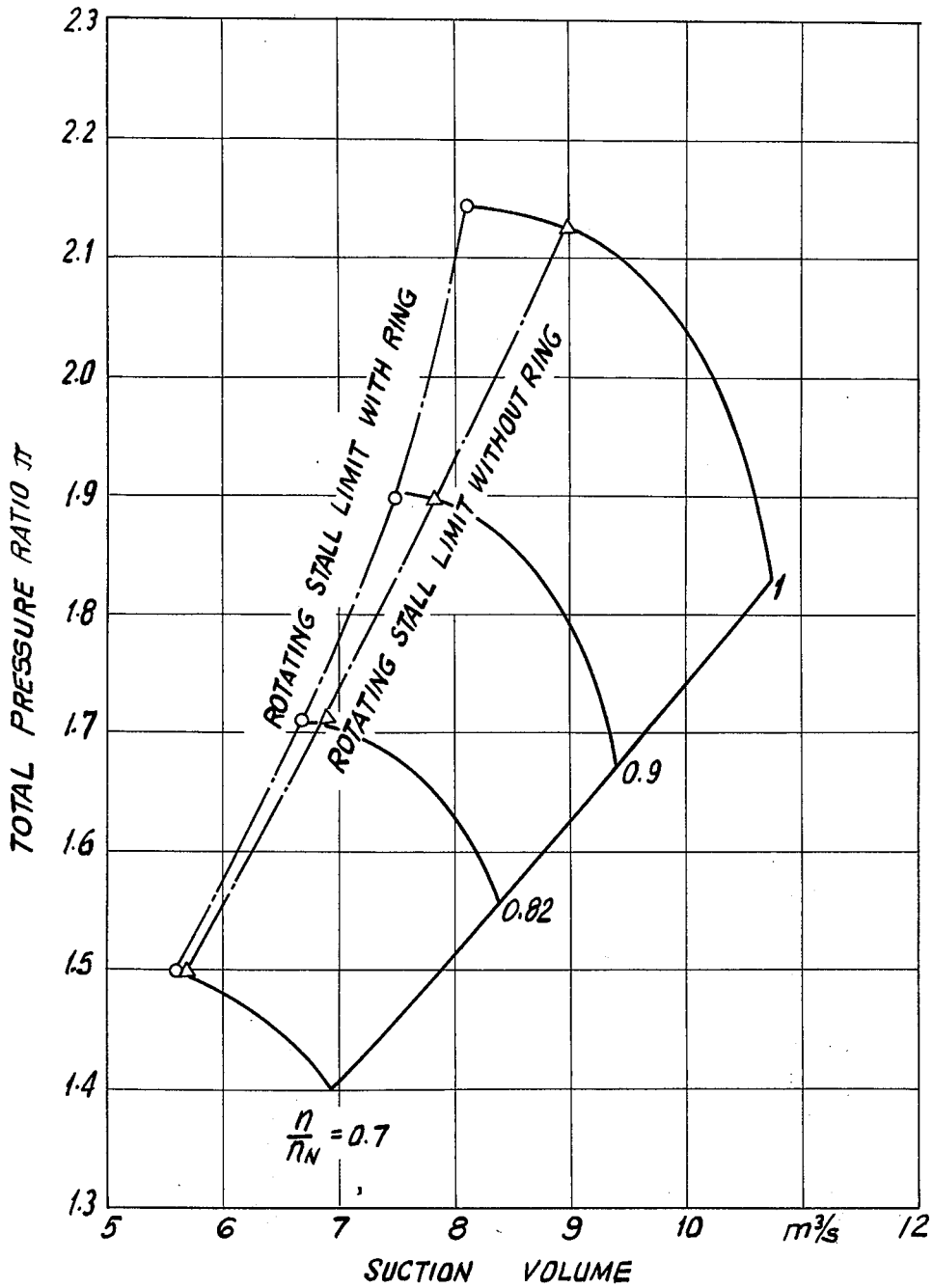
FIG. 3 is a graph showing measured performance characteristics for the compressor.

The result of measurements made with and without the ring according to the present invention is a multistage axial flow compressor are shown in FIG. 3. FIG. 3 represents a measured performance graph with the rotating stall limits being determined over the blade wheel vibrations of the first blade wheel by means of a telemeter. As will be seen from FIG. 3, the rotating stall limit is displaced with a ring in front of the first blade wheel to the left by 9% of the minimum suction volume at nominal speed. This effect can be further increased by an arrangement of additional rings in additional axial compressor stages, as well as by an aerodynamic optimization of the ring used. Furthermore, experimental investigations have shown that flow is stabilized to such an extent in the proximity of the pumping limit by the ring such that rotating stall no longer occurs only periodically, but can also be eliminated after its occurrence, as a result of the influence by the ring conduit flow. In this manner, vibration failures of axial compressor blades caused by rotating stall may be avoided with the use of a ring according to the invention. Furthermore, it has been found that when the ring is installed there is virtually no hysteresis for the occurrence of rotating stall. It has also been found that the total pressure behind the compressor will still rise to the level of the displaced rotating stall limit so that the working range obtained by the displacement of the rotating stall limit may be fully utilized for the axial flow compressor. The term $(n/n_N)$ shown in FIG. 3 means rate of rotation divided by nominal rate of rotation.

While a specific embodiment of the invention has been shown and described in detail to illustrate the application of the invention principles, it will be understood that the invention may be embodied otherwise without departing from such principles.

What is claimed is:

1. An axial flow compressor comprising a rotor having a plurality of rotating blades mounted thereon, a central compressor axis about which said rotor rotates, a casing including an inner casing wall within which said rotor is located, said casing wall defining together with said rotor an annular compressor flow conduit converging in the direction of axial flow through said compressor, a plurality of stationary blades located in said compressor flow conduit upstream of said rotating blades, and a ring of airfoil cross section arranged concentrically to said compressor axis and located in said compressor flow conduit upstream of said rotating blades between said rotating blades and said stationary blades, said airfoil ring being configured and arranged to define together with said casing wall an annular flow channel therebetween converging in the direction of flow through said compressor flow conduit.

2. A compressor according to claim 1 wherein said ring is mounted in said flow conduit by a plurality of radially extending support elements attached between said inner casing wall and said ring to extend through said annular flow channel.

3. A compressor according to claim 1 wherein said annular flow channel includes an annular inlet and an annular outlet, said ring and said inner casing wall being arranged such that the ratio between the area of said inlet and the area of said outlet is between about 1.3 and 2.0 .

4. A compressor according to claim 1 wherein said ring comprises an upstream edge located adjacent said stationary blades and wherein said rotating blades comprise a maximum radial length extending from said rotor, said upstream edge of said ring being located a distance from the central axis of said rotor which is between about 65 to 70 percent of said maximum radial length of said rotating blades.

5. A compressor according to claim 1 wherein said ring comprises an upstream edge located adjacent but spaced from said stationary blades by one gap, and a downstream edge located adjacent but spaced from said rotating blades by another gap, said ring having an axial width extending between said upstream and downstream edges, with the size of both said gaps being at least 10 percent of said axial width of said ring.

6. A compressor according to claim 2 including a retaining ring connecting said support elements to extend from said casing wall.

* * * * *

UNITED STATES PATENT OFFICE

CERTIFICATE OF CORRECTION

Patent No. 4,116,584 Dated Sept. 26, 1978

Inventor(s) KARL BAMMERT & R. STAUDE

It is certified that error appears in the above-identified patent and that said Letters Patent are hereby corrected as shown below:

In the heading of the patent [30] should read as follows:

[30] Foreign Application Priority Data

October 12, 1973 [DE] Fed. Rep. of Germany.....2351308

Signed and Sealed this

Nineteenth Day of December 1978

[SEAL]

Attest:

RUTH C. MASON
Attesting Officer

DONALD W. BANNER
Commissioner of Patents and Trademarks